US008856011B2

(12) United States Patent
Sverrisson et al.

(10) Patent No.: US 8,856,011 B2
(45) Date of Patent: Oct. 7, 2014

(54) EXCITATION SIGNAL BANDWIDTH EXTENSION

(75) Inventors: Sigurdur Sverrisson, Kungsängen (SE); Stefan Bruhn, Sollentuna (SE); Volodya Grancharov, Solna (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 364 days.

(21) Appl. No.: 13/509,849

(22) PCT Filed: Jul. 5, 2010

(86) PCT No.: PCT/SE2010/050772
§ 371 (c)(1),
(2), (4) Date: May 15, 2012

(87) PCT Pub. No.: WO2011/062536
PCT Pub. Date: May 26, 2011

(65) Prior Publication Data

US 2012/0239388 A1 Sep. 20, 2012

Related U.S. Application Data

(60) Provisional application No. 61/262,717, filed on Nov. 19, 2009.

(51) Int. Cl.
*G10L 19/00* (2013.01)
*G10L 19/12* (2013.01)
*G10L 21/038* (2013.01)

(52) U.S. Cl.
CPC ..... *G10L 19/12* (2013.01); *G10L 21/038* (2013.01)
USPC ..... 704/500

(58) Field of Classification Search
CPC ..... G10L 21/038; G10L 19/12
USPC ..... 704/500, 205, 219
See application file for complete search history.

(56) References Cited

U.S. PATENT DOCUMENTS 5,455,888 A * 10/1995 Iyengar et al. ..... 704/203
6,889,182 B2 * 5/2005 Gustafsson ..... 704/205

(Continued)

FOREIGN PATENT DOCUMENTS

EP 1 300 833 A2 4/2003
WO WO 2009/081315 A1 7/2009

OTHER PUBLICATIONS

International Search Report, PCT/SE2010/050772, Feb. 28, 2011.

(Continued)

*Primary Examiner* — Vincent P Harper
(74) *Attorney, Agent, or Firm* — Myers Bigel Sibley & Sajovec, P.A.

(57) ABSTRACT

An apparatus for generating a high band extension of a low band excitation signal ($e_{LB}$) defined by parameters representing a CELP encoded audio signal includes the following elements: upsamplers (20) configured to upsample a low band fixed codebook vector ($u_{FCB}$) and a low band adaptive codebook vector ($u_{ACB}$) to a predetermined sampling frequency. A frequency shift estimator (22) configured to determine a modulation frequency ($\Omega$) from an estimated measure representing a fundamental frequency ($F_0$) of the audio signal. A modulator (24) configured to modulate the upsampled low band adaptive codebook vector ($u_{ACB\uparrow}$) with the determined modulation frequency to form a frequency shifted adaptive codebook vector. A compression factor estimator (28) configured to estimate a compression factor. A compressor (34) configured to attenuate the frequency shifted adaptive codebook vector and the upsampled fixed codebook vector ($u_{FCB\uparrow}$.) based on the estimated compression factor. A combiner (40) configured to form a high-pass filtered sum of the attenuated frequency shifted adaptive codebook vector and the attenuated up-sampled fixed codebook vector.

22 Claims, 9 Drawing Sheets

(56) References Cited

U.S. PATENT DOCUMENTS

| | | | | |
|---|---|---|---|---|
| 7,216,074 | B2 * | 5/2007 | Malah et al. | 704/205 |
| 2003/0093279 | A1 | 5/2003 | Malah et al. | |
| 2004/0078194 | A1 | 4/2004 | Liljeryd et al. | |
| 2007/0067163 | A1 | 3/2007 | Kabal et al. | |

OTHER PUBLICATIONS

Written Opinion of the International Searching Authority, PCT/SE2010/050772, Feb. 28, 2011.

International Preliminary Report on Patentability, PCT/SE2010/050772, Dec. 13, 2011.

Jax et al., "On artificial bandwidth extension of telephone speech", *Signal Processing*, 83:1707-1719 (2003).

Communication with Supplementary European Search Report, European Patent Application No. EP 10 83 1865, Apr. 15, 2013.

Chan et al., "Quality Enhancement of Narrowband CELP-Coded Speech Via Wideband Harmonic Re-Synthesis", *ICASSP '97, Proceedings of the 1997 IEEE International Conference on Acoustics, Speech, and Signal Processing*, V. 2, Apr. 21, 1997, pp. 1187-1190, XP010226012.

Epps et al., "Speech Enhancement Using STC-Based Bandwidth Extension" *The 5th International Conference on Spoken Language Processing, Incorporating the 7th Australian International Speech Science and Technology Conference*, Sydney Convention Centre, Sydney, Australia, Nov. 30-Dec. 4, 1998, 4 pp., XP007000515.

* cited by examiner

EXCITATION SIGNAL BANDWIDTH EXTENSION

CROSS REFERENCE TO RELATED APPLICATIONS

This application is a 35 U.S.C. §371 national stage application of PCT International Application No. PCT/SE2010/050772, filed on 5 Jul. 2010 , which itself claims priority to U.S. provisional Patent Application No. 61/262,717, filed 19 Nov. 2009, the dislosure and content of both of which are incorporated by reference herein their entirety. The above-reference PCT International Application was published in the English language as International Publication No. WO 2011/062536 A1 on 26 May 2011.

TECHNICAL FIELD

The present invention relates generally to audio or speech decoding, and in particular to bandwidth extension (BWE) of excitation signals used in the decoding process.

BACKGROUND

In many types of codecs the input waveform is split into a spectrum envelope and an excitation signal (also called residual), which are coded and transmitted independently. At the decoder the waveform is synthesized from the received envelope and excitation information.

An efficient way to parameterize the spectrum envelope is through linear predictive (LP) coefficients a(j). The process of separation into spectrum envelope and excitation signal e(k) consists of two major steps: 1) estimation of LP coefficients, and 2) filtering the waveform x(k) through an all-zero filter $$A(z) = 1 - \sum_{j=1}^{J} a(j)z^{-j} \tag{1}$$

to generate an excitation signal e(k), where the model order J is typically set to 10 for input signals sampled at 8 kHz, and to 16 for input signals sampled at 16 kHz. This process is illustrated in FIG. 1.

To minimize transmission load, the audio signal is often lowpass filtered and only the low band (LB) is encoded and transmitted. At the receiver end the high band (HB) may be recovered from the available LB signal characteristics. The process of reconstruction of HB signal characteristics from certain LB signal characteristics is performed by a BWE scheme.

A straightforward reconstruction method is based on spectral folding, where the spectrum of the LB part of the excitation signal is folded (mirrored) around the upper frequency limit of the LB. A problem with such straightforward spectral folding is that the discrete frequency components may not be positioned at integer multiplies of the fundamental frequency of the audio signal. This results in "metallic" sounds and perceptual degradation when reconstructing the HB part of the excitation signal e(k) from the available LB excitation.

One way to avoid this problem is by reconstructing the HB excitation as a white noise sequence, [1-2]. However, replacement of the actual residual (HB excitation) with white noise leads to perceptual degradations, as in certain parts of a speech signal, periodicity continues in the HB.

Reference [3] describes a reconstruction method based on a complex speech production model for generating the HB extension of the excitation signal.

SUMMARY

An object of the present invention is an improved generation of a high band extension of a low band excitation signal.

This object is achieved in accordance with the attached claims.

According to a first aspect the present invention involves a method of generating a high band extension of a low band excitation signal defined by parameters representing a CELP encoded audio signal. This method includes the following steps. A low band fixed codebook vector and a low band adaptive codebook vector are upsampled to a predetermined sampling frequency. A modulation frequency is determined from an estimated measure representing the fundamental frequency of the audio signal. The upsampled low band adaptive codebook vector is modulated with the determined modulation frequency to form a frequency shifted adaptive codebook vector. A compression factor is estimated. The frequency shifted adaptive codebook vector and the upsampled fixed codebook vector are attenuated based on the estimated compression factor. Then a high-pass filtered sum of the attenuated frequency shifted adaptive codebook vector and the attenuated upsampled fixed codebook vector is formed.

According to a second aspect the present invention involves a method of generating a high band extension of a low band excitation signal that has been obtained by source-filter model based encoding of an audio signal. This method includes the following steps. The low band excitation signal is upsampled to a predetermined sampling frequency. A modulation frequency is determined from an estimated measure representing the fundamental frequency of the audio signal. The upsampled low band excitation signal is modulated with the determined modulation frequency to form a frequency shifted excitation signal. The frequency shifted excitation signal is high-pass filtered. A compression factor is estimated. The high-pass filtered frequency shifted excitation signal is attenuated based on the estimated compression factor.

According to a third aspect the present invention involves an apparatus for generating a high band extension of a low band excitation signal defined by parameters representing a CELP encoded audio signal. Upsamplers are configured to upsample a low band fixed codebook vector and a low band adaptive codebook vector to a predetermined sampling frequency. A frequency shift estimator is configured to determine a modulation frequency from an estimated measure representing the fundamental frequency of the audio signal. A modulator is configured to modulate the upsampled low band adaptive codebook vector with the determined modulation frequency to form a frequency shifted adaptive codebook vector. A compression factor estimator is configured to estimate a compression factor. A compressor is configured to attenuate the frequency shifted adaptive codebook vector and the upsampled fixed codebook vector based on the estimated compression factor. A combiner is configured to form a high-pass filtered sum of the attenuated frequency shifted adaptive codebook vector and the attenuated upsampled fixed codebook vector.

According to a fourth aspect the present invention involves an apparatus for generating a high band extension of a low band excitation signal that has been obtained by source-filter model based encoding of an audio signal. An upsampler is configured to upsample the low band excitation signal to a predetermined sampling frequency. A frequency shift estimator is configured to determine a modulation frequency from an estimated measure representing the fundamental frequency of the audio signal. A modulator is configured to modulate the upsampled low band excitation signal with the determined modulation frequency to form a frequency shifted excitation signal. A high-pass filter is configured to high-pass filter the frequency shifted excitation signal. A compression factor estimator is configured to estimate a compression factor. A compressor is configured to attenuate the high-pass filtered frequency shifted excitation signal based on the estimated compression factor.

According to a fifth aspect the present invention involves an excitation signal bandwidth extender including an apparatus in accordance the third or forth aspect.

According to a sixth aspect the present invention involves a speech decoder including an excitation signal bandwidth extender in accordance with the fifth aspect.

According to a seventh aspect the present invention involves a network node including a speech decoder in accordance with the sixth aspect.

An advantage of the present invention is that the result is an improved subjective quality. The quality improvement is due to a proper shift of tonal components, and a proper ratio between tonal and random parts of the excitation.

Another advantage of the present invention is an increased computational efficiency compared to [3], due to the fact that it is not based on a complex speech production model. Instead the HB extension is derived directly from features of the LB excitation.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
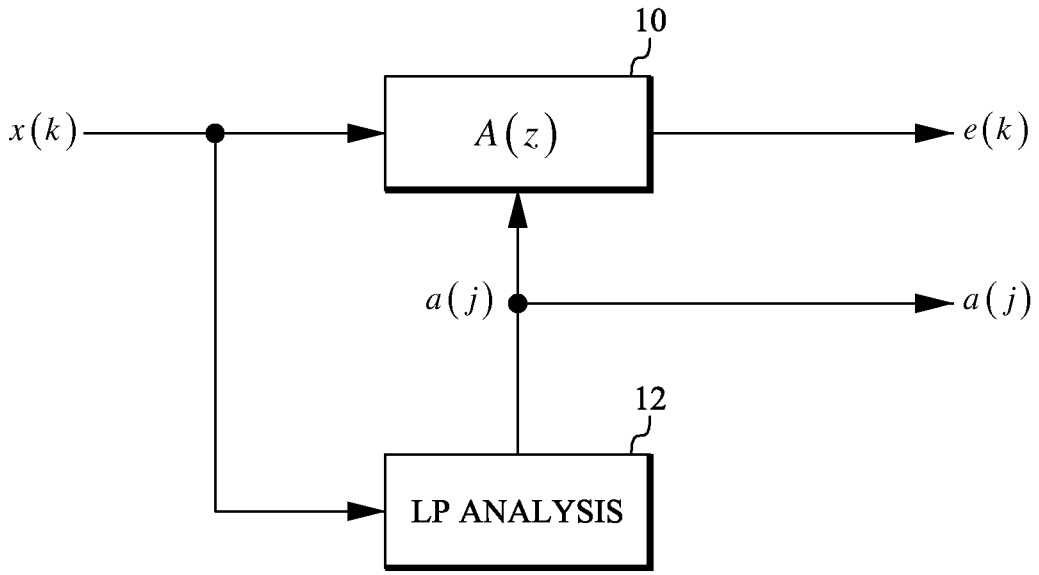
FIG. 1 is a simple block diagram illustrating the general principles of source-filter model based audio signal encoding.

Elements having the same or similar functions will be provided with the same reference designations in the drawings.

Before several example embodiments of the invention are described in detail, some concepts that will facilitate this description will briefly be described with reference to FIG. 1-5.

FIG. 1 is a simple block diagram illustrating the general principles of source-filter model based audio signal encoding. The excitation signal e(k) is calculated by filtering the waveform x(k) through an all-zero filter 10 having a transfer function A(z), defined by filter coefficients a(j). The filter coefficients a(j) are determined by linear predictive (LP) analysis in block 12. In this type of encoding the input waveform or signal x(k) is represented by the excitation signal e(k) and the filter coefficients a(j), which are sent to the decoder.

Figure 2:
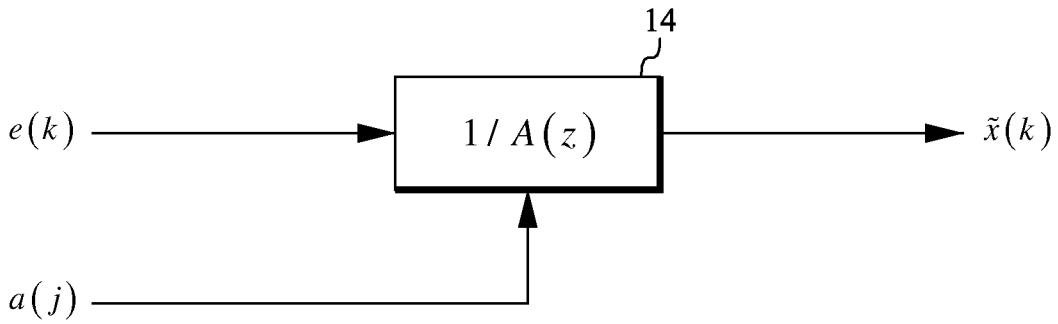
FIG. 2 is a simple block diagram illustrating the general principles of source-filter model based audio signal decoding.

FIG. 2 is a simple block diagram illustrating the general principles of source-filter model based audio signal decoding. The decoder receives the excitation signal e(k) and the filter coefficients a(j) from the encoder, and reconstructs an approximation $\tilde{x}(k)$ of the original waveform x(k) . This is done by filtering the received excitation signal e(k) through an all-pole filter 14 having a transfer function 1/A(z), defined by the received filter coefficients a(j).

Figure 3:
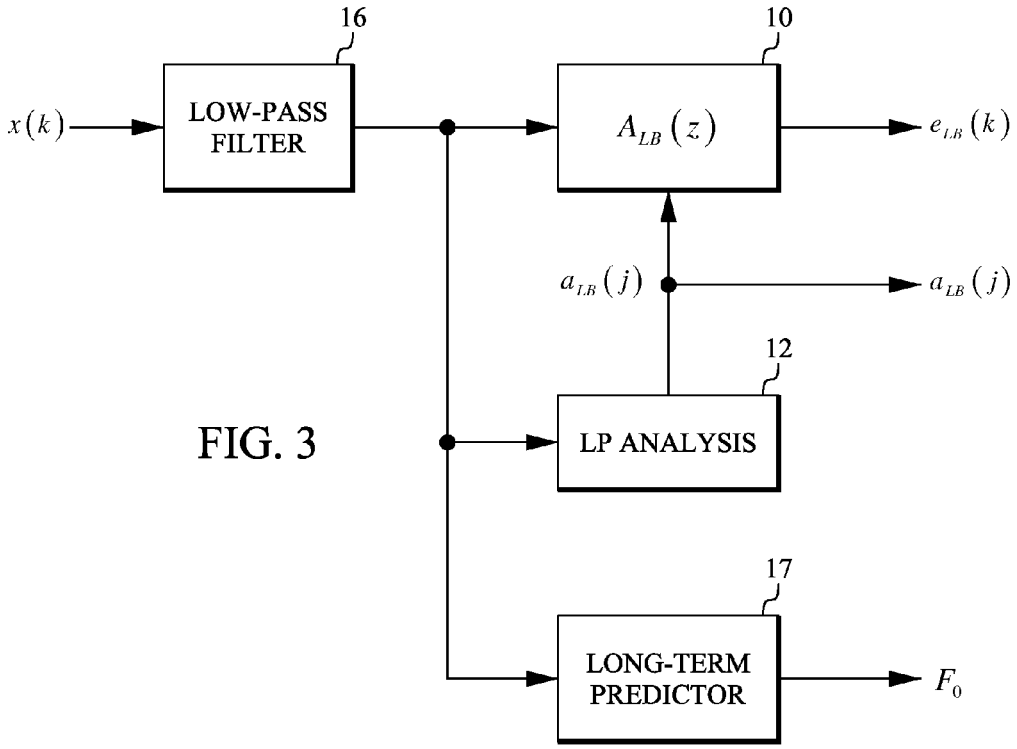
FIG. 3 is a simple block diagram illustrating encoding with lowpass filtering of the audio signal to be encoded.

FIG. 3 is a simple block diagram illustrating encoding with lowpass filtering of the audio signal to be encoded. As noted above, to minimize transmission load, the audio signal is often lowpass filtered and only the low band is encoded and transmitted. This is illustrated by a low-pass filter 16 inserted between the wideband signal x(k) to be encoded and the all-zero filter 10. Since the input signal x(k) has been low-pass filtered before encoding, the resulting excitation signal $e_{LB}(k)$ will only include the low band contribution of the complete excitation signal required to reconstruct x(k) at the decoder. Similarly the filter 10 will now have a low band transfer function $A_{LB}(z)$, defined by low band filter coefficients $a_{LB}(j)$. Furthermore, the encoder may include a long-term predictor 17 that estimates a measure (typically called the "pitch lag" or "pitch period" or simply the "pitch" of x(k)) representing the fundamental frequency $F_0$ of the input signal. This may be done either on the low-pass filtered input signal, as illustrated in FIG. 3, or on the original input signal x(k). Another alternative is to estimate the measure representing the fundamental frequency $F_0$ from the excitation signal $e_{LB}(k)$. Information representing the parameters $e_{LB}(k)$, $a_{LB}(j)$ and $F_0$ is sent to the decoder. If the measure representing the fundamental frequency $F_0$ is to be estimated from the excitation signal $e_{LB}(k)$, it is actually also possible to perform the estimation at the decoding side, in which case no information representing the fundamental frequency $F_0$ has to be sent.

Figure 4:
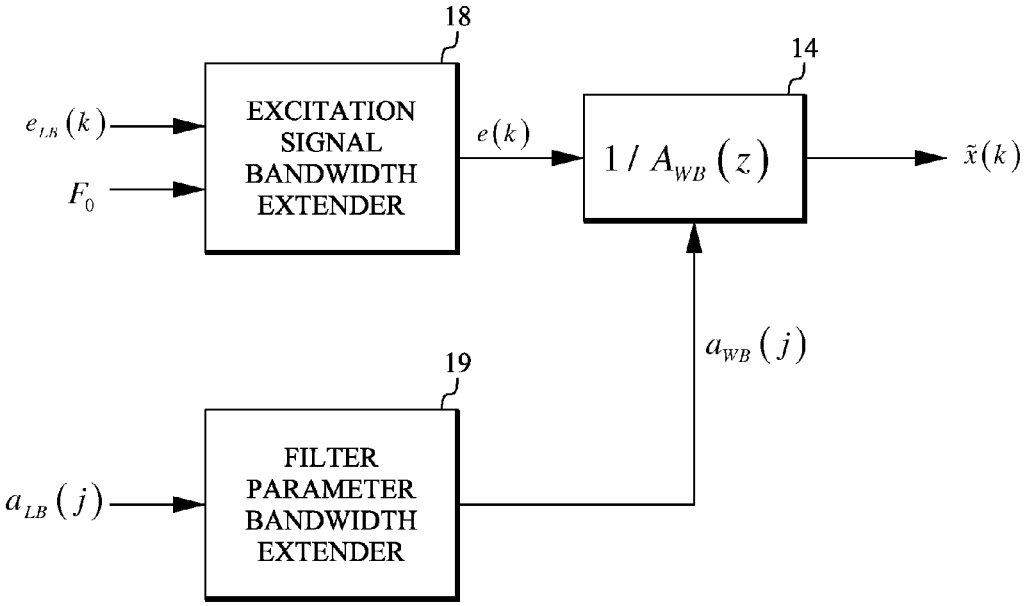
FIG. 4 is a simple block diagram illustrating an example embodiment of a speech decoder in accordance with the present invention including an excitation signal bandwidth extender in accordance with the present invention.

FIG. 4 is a simple block diagram illustrating an example embodiment of a speech decoder in accordance with the present invention including an excitation signal bandwidth extender in accordance with the present invention. This speech decoder may be used to decode a signal that has been encoded in accordance with the principles discussed with reference to FIG. 3. The decoder receives the excitation signal $e_{LB}(k)$ and the filter coefficients $a_{LB}(j)$ and the measure representing the fundamental frequency $F_0$ (if sent by the encoder, otherwise it is estimated at the decoding side) from the encoder, and reconstructs an approximation $\tilde{x}(k)$ of the original (wideband) waveform x(k). This is done by forwarding the excitation signal $e_{LB}(k)$ and the fundamental frequency measure $F_0$ to an excitation signal bandwidth extender 18 in accordance with the present invention (will be described in detail below). Excitation signal bandwidth extender 18 generates the (wideband) excitation signal e(k) and filters it through the all-pole filter 14 to reconstruct the (wideband) approximation $\tilde{x}(k)$. However, this requires that the filter 14 has a wideband transfer function $1/A_{WB}(z)$, defined by corresponding filter coefficients $a_{WB}(j)$. For this reason the decoder includes a filter parameter bandwidth extender 19 that converts the received filter coefficients $a_{LB}(j)$ into $a_{WB}(j)$. This type of conversion is described in, for example [3], and will not be described further here. Instead it will be assumed that the filter transfer function $1/A_{WB}(z)$ is known by the decoder. Thus, the following description will focus on the principles for generating the bandwidth extended excitation signal e(k).

Figure 5A:
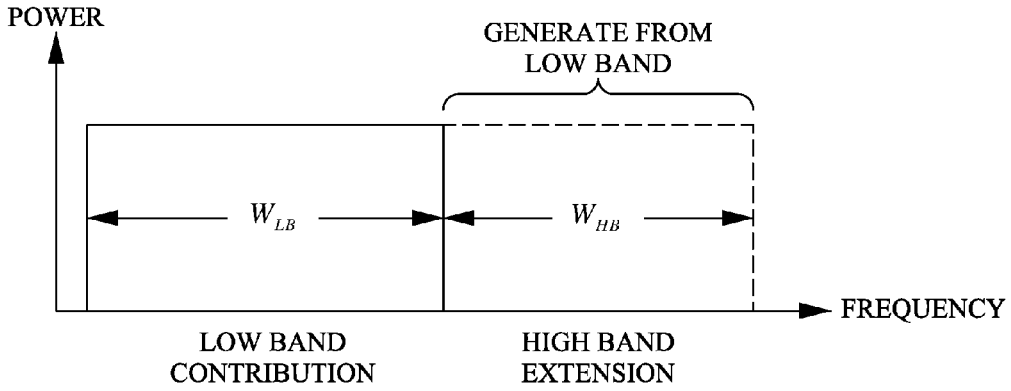
FIG. 5A-C are diagrams illustrating bandwidth extension of an audio signal.
Figure 5B:
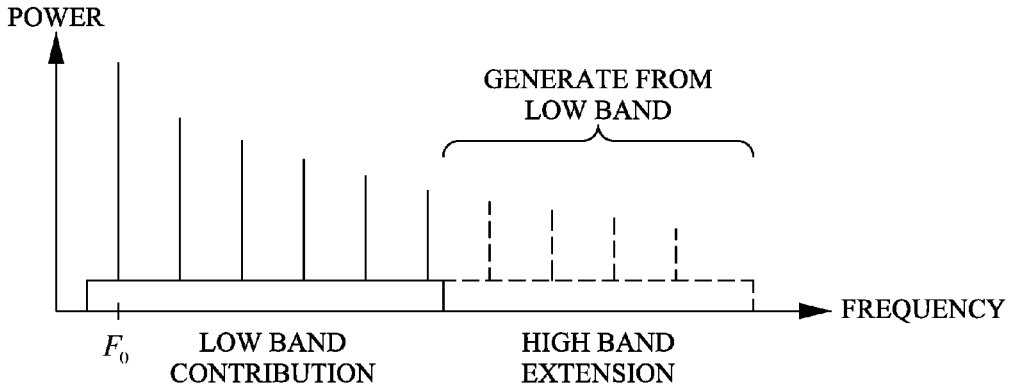
Figure 5C:
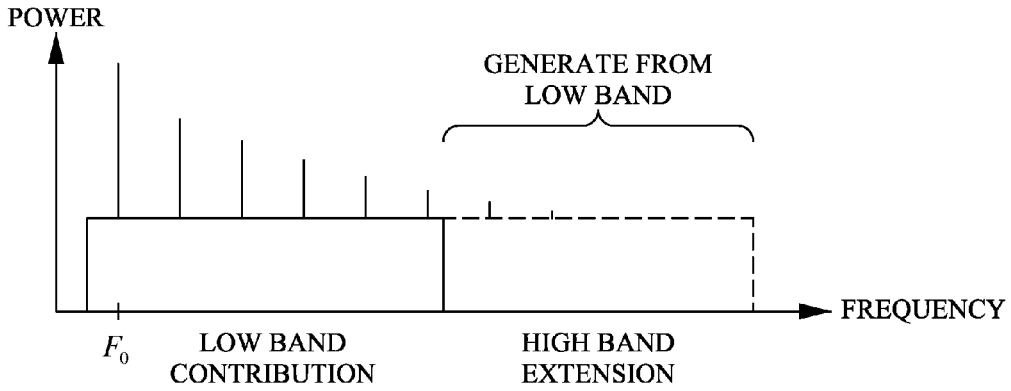

FIG. 5A-C are diagrams illustrating bandwidth extension of an audio signal. FIG. 5A schematically illustrates the power spectrum of an audio signal. The spectrum consists of two parts, namely a low band part (solid), having a bandwidth $W_{LB}$, and a high band part (dashed), having a bandwidth $W_{HB}$. The task of the decoder is to generate the high band extension when only characteristics of the low band contribution are available.

The power spectrum in FIG. 5A would only represent white noise. More realistic power spectra are illustrated in FIG. 5B-C. Here the spectra have different mixes of tonal (the spikes) and random components (the rectangles). Methods that regenerate the harmonic structure at high frequencies have to deal with the fact that the HB residual does not exhibit as strong tonal components as the LB residual. If not properly attenuated, the HB residual will introduce annoying perceptual artifacts. The present invention is concerned with generation of the high band extension of the excitation signal e(k) in such a way that the dashed spikes representing harmonics of the fundamental frequency $F_0$ have the correct positions in the extended power spectrum and that the ratio between tonal and random parts of the extended power spectrum is correct. How this can be accomplished will now be described with reference to FIG. 6-11.

Figure 6:
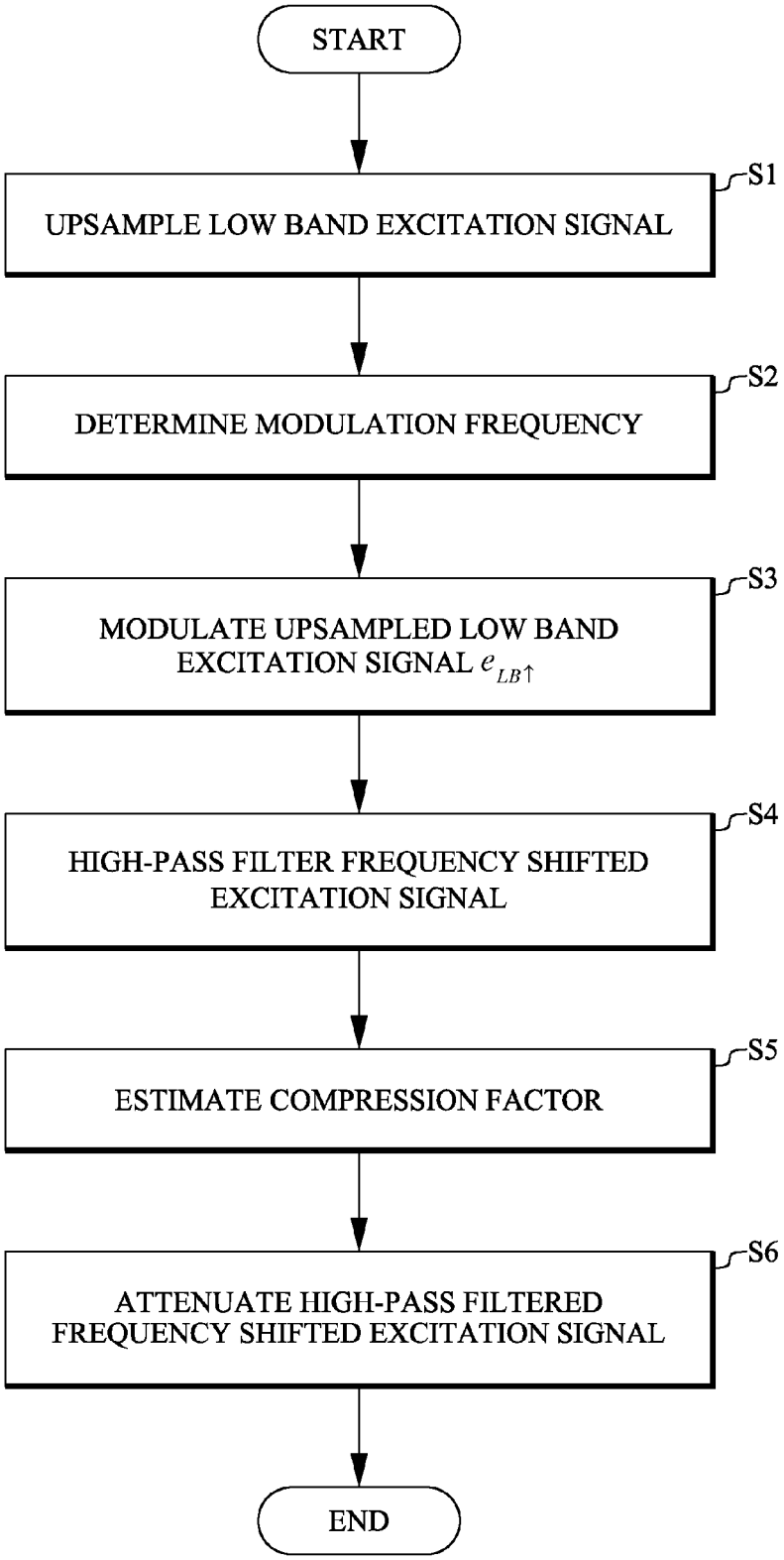
FIG. 6 is a flow chart illustrating an example embodiment of the method in accordance with the present invention.

FIG. 6 is a flow chart illustrating an example embodiment of the method in accordance with the present invention. Step S1 upsamples the low band excitation signal $e_{LB}$ to match a desired output sampling frequency $f_S$. Typical examples of input (received) and output sampling frequencies $f_S$ are 4 kHz to 8 kHz, or 12.8 kHz to 16 kHz. Step S2 determines a modulation frequency Ω from the estimated measure representing the fundamental frequency $F_0$ of the audio signal. In a preferred embodiment this is done in accordance with $$\Omega = n \cdot \frac{2\pi F_0}{f_S} \tag{2}$$

where n is defined as $$n = \text{floor}\left(\frac{W_{LB}}{F_0}\right) - \text{ceil}\left(\frac{W_{LB} - W_{HB}}{F_0}\right) \tag{3}$$

where floor rounds its argument to the nearest smaller integer, ceil rounds its argument to the nearest larger integer, $W_{LB}$ is the bandwidth of the low band excitation signal $e_{LB}$, and $W_{HB}$ is the bandwidth of the high band extension $e_{HB}$.

There are many alternative ways to calculate the modulation frequency Ω. Instead of listing a lot of equations, the purpose of the different parts of equation (3) will be described. The quantity n is intended to give the number of multiples of the fundamental frequency $F_0$ that fit into the high band $W_{HB}$.

These will be shifted from the band that extends from $W_{LB}-W_{HB}$ to $W_{LB}$. This band, which is narrower than $W_{LB}$, will be called $W_S$. Thus, we need to find the number of harmonics (the spikes in FIG. 5A-C) that fit into the band $W_S$. The first part of equation (3) will find the number of harmonics that fit into the entire low band from 0 to $W_{LB}$. The second part of equation (3) will find the number of harmonics that fit into the band from 0 to $W_{LB}-W_{HB}$. The number of harmonics that fit into the band $W_S$ is based on the difference between these parts. However, since we want to find the maximum number of harmonics that have a frequency less than or equal to $W_S$, we need to round down, so we use the "floor" function on the first part and the "ceil" function on the second part (since it is subtracted).

The estimated modulation frequency Ω gives the proper number of multiples of the fundamental frequency $F_0$ to fill $W_{HB}$.

As an alternative the pitch lag, which is formed by the inverse of the fundamental frequency $F_0$ and represents the period of the fundamental frequency, could be used in (2) and (3) by a corresponding simple adaptation of the equations. Both parameters are regarded as a measure representing the fundamental frequency.

In step S3 the upsampled low band excitation signal $e_{LB\uparrow}$ is modulated with the determined modulation frequency Ω to form a frequency shifted excitation signal. In a preferred embodiment this is done in accordance with $$A \cdot \cos(l \cdot \Omega) \tag{4}$$

where

A is a predetermined constant, and l is a sample index.

This time domain modulation corresponds to a translation or shift in the frequency domain, as opposed to the prior art spectral folding, which corresponds to mirroring.

The gain A controls the power of the output signal. The preferred value A=2 leaves the power unchanged. Alternatives to the modulation by a cosine function are sine and exponential functions.

Step S4 high-pass filters the frequency shifted excitation signal to remove aliasing.

Since the HB excitation signal $e_{HB}$ typically contains less periodic components than LB excitation signal $e_{LB}$, one has to further attenuate these tonal components in the frequency shifted LB excitation signal based on a compression factor λ. Step S5 estimates this compression factor λ. As an example of a measure for the amount of tonal components, one can use a modified Kurtosis $$K = \frac{\frac{1}{L}\sum_{l=1}^{L} e^4(l)}{\left(\frac{1}{L}\sum_{l=1}^{L} e^2(l)\right)^2} \tag{5}$$

where e(l) is the signal on which the measurement is performed, and

L is a speech frame length.

A preferred method of estimating the compression factor λ is based on a lookup table. The lookup table may be created offline by the following procedure:

1) Over a speech database the LB and HB Kurtosis in (5) (with e(l) replaced by $e_{LB}(l)$ and $e_{HB}(l)$, respectively) is calculated on a frame by frame basis.

2) An optimal compression factor λ is found as the one that would compress the reconstructed HB excitation signal to match as good as possible the true HB Kurtosis.

In more detail, in a preferred embodiment 1) separately calculates the Kurtosis according to (5) for the LB part and HB part for the speech signals in the database. In 2) the Kurtosis according to (5) of the HB part is again calculated, but this time by using only the LB part of the signals in the database and performing steps S1-S4 and attenuating the high-pass filtered frequency shifted excitation signal e(l) to an attenuated signal ẽ(l) defined by $$\tilde{e}(l) = C_{max} \cdot \mathrm{sign}(e(l)) \cdot \left| \frac{e(l)}{C_{max}} \right|^{\lambda} \tag{6}$$

where l is a sample index, and $C_{max}$ is a predetermined constant corresponding to a largest allowed excitation amplitude.

The Kurtosis according to (5) is calculated for the attenuated signal ẽ(l) with different choices of λ, and the value of λ that gives the best match with the exact Kurtosis based on $e_{HB}(l)$ is associated with the corresponding Kurtosis for $e_{LB}(l)$. This procedure creates the following lookup table:

| LB Kurtosis | Compression factor |
|---|---|
| $K_1$ | $\lambda_1$ |
| $K_2$ | $\lambda_2$ |
| . | . |
| . | . |
| . | . |

This lookup table can be seen as a discrete function that maps the Kurtosis of the LB into an optimal compression factor λ≥1. It is appreciated that, since there are only a finite number of values for λ, each calculated Kurtosis is classified ("quantized") to belong to a corresponding Kurtosis interval before actual table lookup.

An alternative to the measure (5) for the amount of tonal components is $$K = \frac{\exp\left(\frac{1}{L}\sum_{l=1}^{L}\log(e^2(l))\right)}{\left(\frac{1}{L}\sum_{l=1}^{L}e^2(l)\right)^2} \tag{7}$$

The compression factor λ may be estimated with the procedure as described above with the measure (5) replaced by the measure (7).

Returning to FIG. 6, in the example embodiment of the method of generating a high band extension, the optimal compression factor λ for the HB excitation signal is obtained from such a pre-stored lookup table, by matching the LB Kurtosis of the current speech segment. Step S6 then attenuates the high-pass filtered frequency shifted excitation signal based on the estimated compression factor λ. In the example embodiment the attenuation is in accordance with (6). As an option this type of compression can be followed by a high-pass filtering step, to avoid introducing frequency domain artifacts.

As another option the compression may be frequency selective, where more compression is applied at higher frequencies. This can be achieved by processing the excitation signal in the frequency domain, or by appropriate filtering in the time domain.

Figure 7:
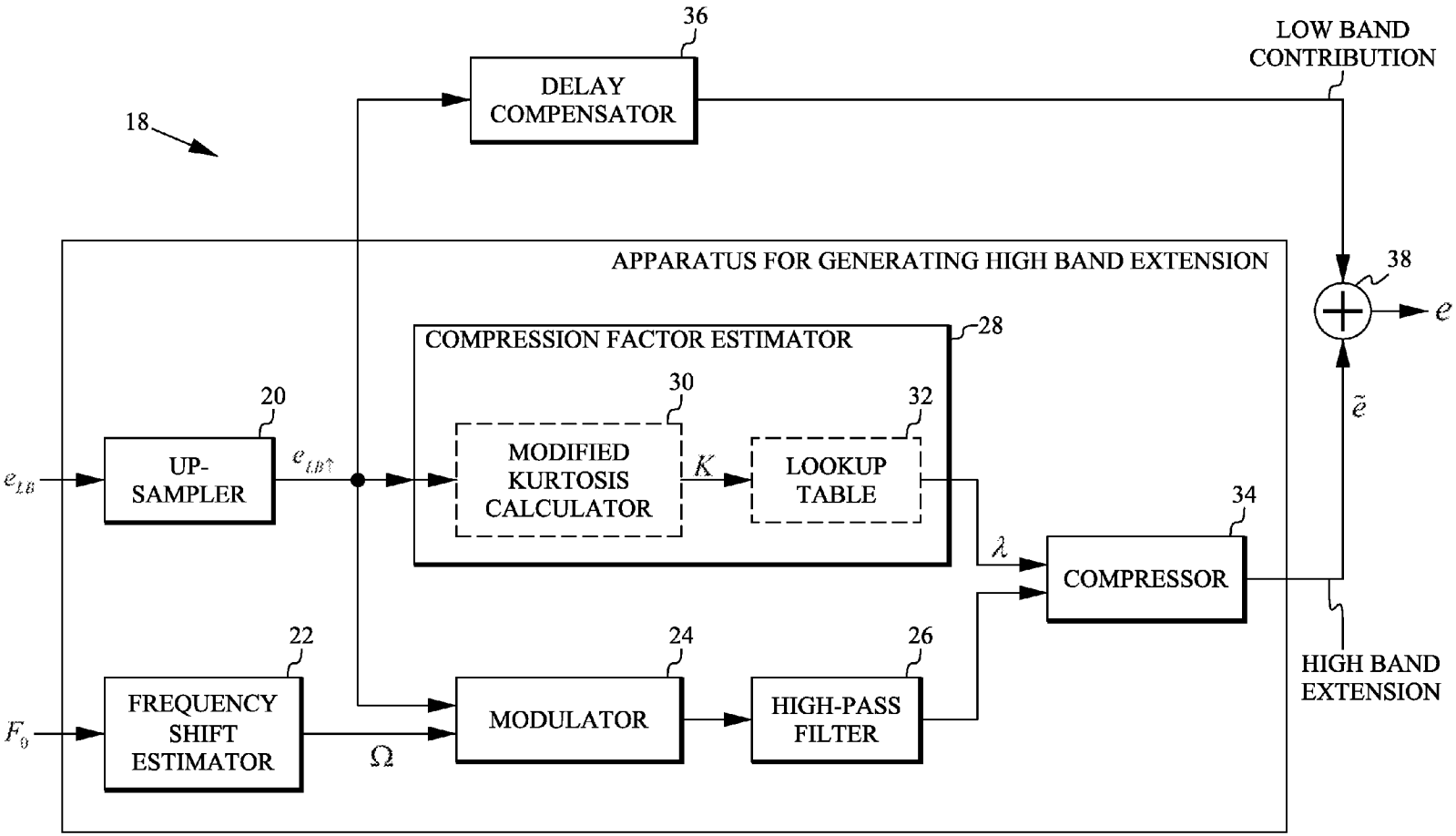
FIG. 7 is a block diagram illustrating an excitation signal bandwidth extender including an example embodiment of the apparatus in accordance with the present invention.

FIG. 7 is a block diagram illustrating an excitation signal bandwidth extender 18 including an example embodiment of the apparatus in accordance with the present invention. This apparatus includes an upsampler 20 configured to upsample the low band excitation signal $e_{LB}$ to the predetermined sampling frequency $f_S$. A frequency shift estimator 22 is configured to determine a modulation frequency Ω, for example in accordance with (2)-(3), from the estimated measure representing the fundamental frequency $F_0$. A modulator 24 is configured to modulate the upsampled low band excitation signal $e_{LB\uparrow}$ with the determined modulation frequency Ω to form a frequency shifted excitation signal. A high-pass filter 26 is configured to high-pass filter the frequency shifted excitation signal. A compression factor estimator 28 is configured to estimate a compression factor λ, for example from a pre-stored lookup table as described above. In a particular example the compression factor estimator 28 includes a modified Kurtosis calculator 30 connected to a lookup table 32. A compressor 34 is configured to attenuate the high-pass filtered frequency shifted excitation signal based on the estimated compression factor λ, for example in accordance with (6). In the bandwidth extender 18 the upsampled LB excitation signal $e_{LB\uparrow}$ is also forwarded to a delay compensator 36, which delays it to compensate for the delay caused by the generation of the HB extension ẽ(l). The resulting delayed LB contribution is added to the HB extension ẽ(l) in an adder 38 to form the bandwidth extended excitation signal e. As an option a high-pass filter may be inserted between the compressor 34 and the adder 38 to avoid introducing frequency domain artifacts.

Figure 8:
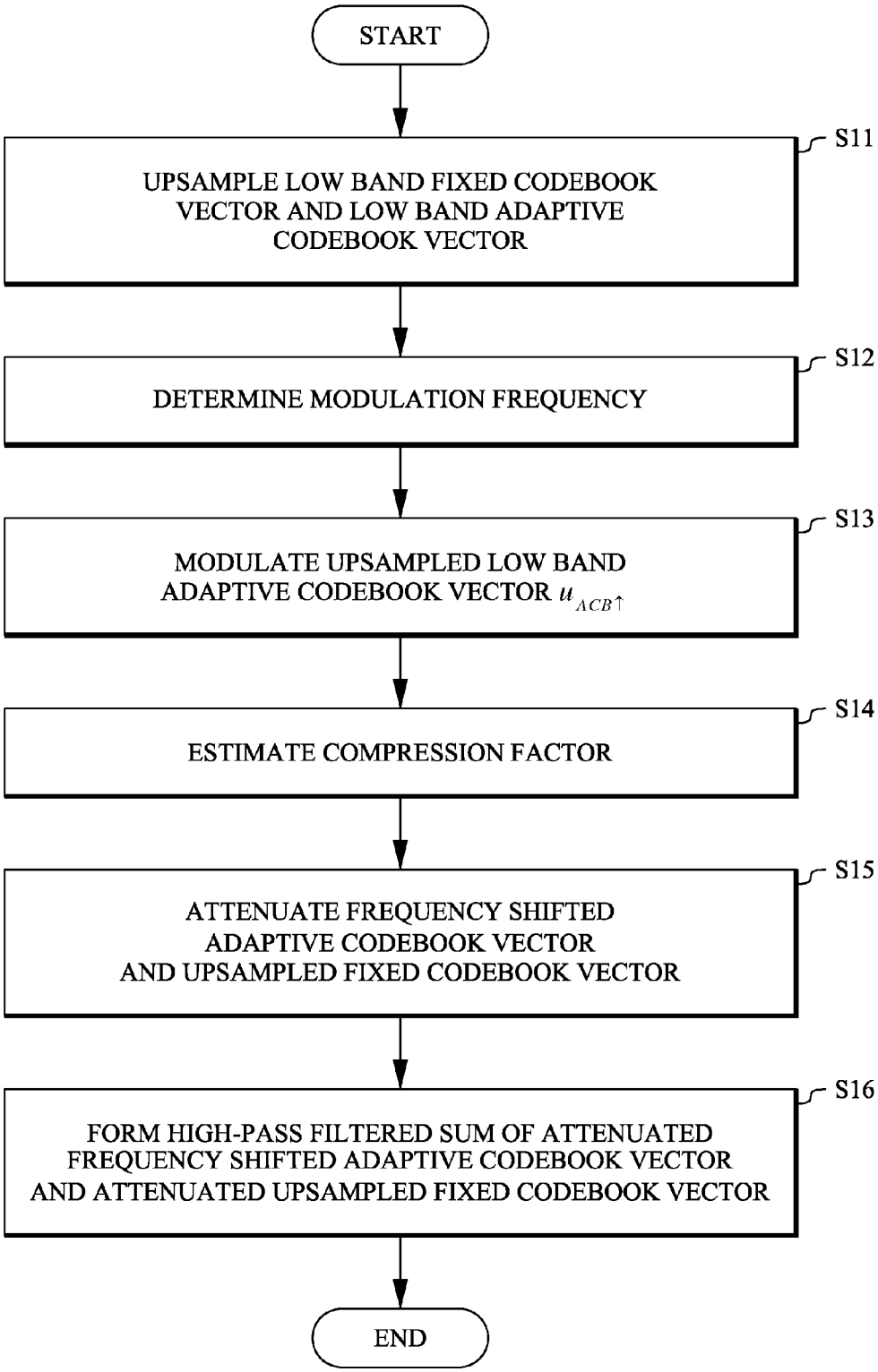
FIG. 8 is a flow chart illustrating another example embodiment of the method in accordance with the present invention.

FIG. 8 is a flow chart illustrating another example embodiment of the method in accordance with the present invention. This embodiment is based on Code Excited Linear Prediction (CELP) coding, for example Algebraic Code Excited Linear Prediction (ACELP) coding. In CELP coding the excitation signal is formed by a linear combination of a fixed codebook vector (random component) and an adaptive codebook vector (periodic component), where the coefficients of the combination are called gains. In ACELP the fixed codebook does not require an actual "book" or table of vectors. Instead the fixed codebook vectors are formed by positioning pulses in vector positions determined by an "algebraic" procedure. The following description will describe this embodiment of the invention with reference to ACELP. However, it is appreciated that the same principles may also be used for CELP.

Since in the ACELP scheme the LB excitation vector is readily split into periodic and random components:

$$e_{LB}=G_{ACB}\cdot u_{ACB}+G_{FCB}\cdot u_{FCB} \tag{8}$$

one can manipulate these components directly and consider an alternative measure to control the level of compression at the HB. The inputs are the LB adaptive and fixed codebook vectors $u_{ACB}$ and $u_{FCB}$, respectively, together with their corresponding gains $G_{ACB}$ and $G_{FCB}$, and also the measure representing the fundamental frequency $F_0$ (either received from the encoder or determined at the decoder, as discussed above).

In this example embodiment step S11 upsamples the LB adaptive and fixed codebook vectors $u_{ACB}$ and $u_{FCB}$ to match a desired output sampling frequency $f_S$. Step S12 determines a modulation frequency Ω from the estimated measure representing the fundamental frequency $F_0$ of the audio signal. In a preferred embodiment this is done in accordance with (2)-(3). Step S13 modulates the upsampled low band adaptive codebook vector $u_{ACB\uparrow}$, which contains the tonal part of the residual, with the determined modulation frequency Ω to form a frequency shifted adaptive codebook vector. In this embodiment it is sufficient to just upsample the fixed codebook vector $u_{FCB}$, since it is a noise-like signal. Step S14 estimates a compression factor λ. The optimal compression factor λ may be obtained from a lookup table, as in the embodiments described with reference to FIGS. 6 and 7, but with the measure $$K = \frac{G_{ACB}^2 \cdot \sum u_{ACB}^2(l)}{G_{FCB}^2 \cdot \sum u_{FCB}^2(l)} \tag{9}$$

In another example the measure K is given by $$K = \frac{G_{ACB}^2 \cdot \sum u_{ACB}^2(l) - G_{FCB}^2 \cdot \sum u_{FCB}^2(l)}{\sum e_{LB}^2(l)} \tag{10}$$

Yet another possibility is to implement the metric or measure K as a ratio between low- and high-order prediction variances, as described in [2]. In this embodiment the measure K is defined as the ratio between low- and high-order LP residual variances $$K = \frac{\sigma_{e,2}^2}{\sigma_{e,16}^2} \tag{11}$$

where $\sigma_{e,2}^2$ and $\sigma_{e,16}^2$ denote the LP residual variances for second-order and 16th-order LP filters, respectively. The LP residual variances are readily obtained as a by-product of the Levinson-Durbin procedure.

The metric or measure K controlling the amount of compression may also be calculated in the frequency domain. It can be in the form of spectral flatness, or the amount of frequency components (spectral peaks) exceeding a certain threshold.

Step S15 attenuates the frequency shifted adaptive codebook vector and the upsampled fixed codebook vector $u_{FCB\uparrow}$ based on the estimated compression factor λ. An example of a suitable attenuation for this embodiment is $$\begin{cases} \tilde{G}_{ACB} = \lambda \cdot G_{ACB} \\ \tilde{G}_{FCB} = \sqrt{1 - \tilde{G}_{ACB}^2} \end{cases} \tag{12}$$

In the embodiment where the compression factor λ is selected from a lookup table based on (9) it may, for example, belong to the set {0.2, 0.4, 0.6, 0.8}.

Step S16 in FIG. 8 forms a high-pass filtered sum of the attenuated frequency shifted adaptive codebook vector and the attenuated upsampled fixed codebook vector. This can be done either by high-pass filtering the attenuated frequency shifted adaptive codebook vector and the attenuated upsampled fixed codebook vector first and forming the sum after filtering or by forming the sum of the attenuated frequency shifted adaptive codebook vector and the attenuated upsampled fixed codebook vector first and high-pass filter the sum instead.

Figure 9:
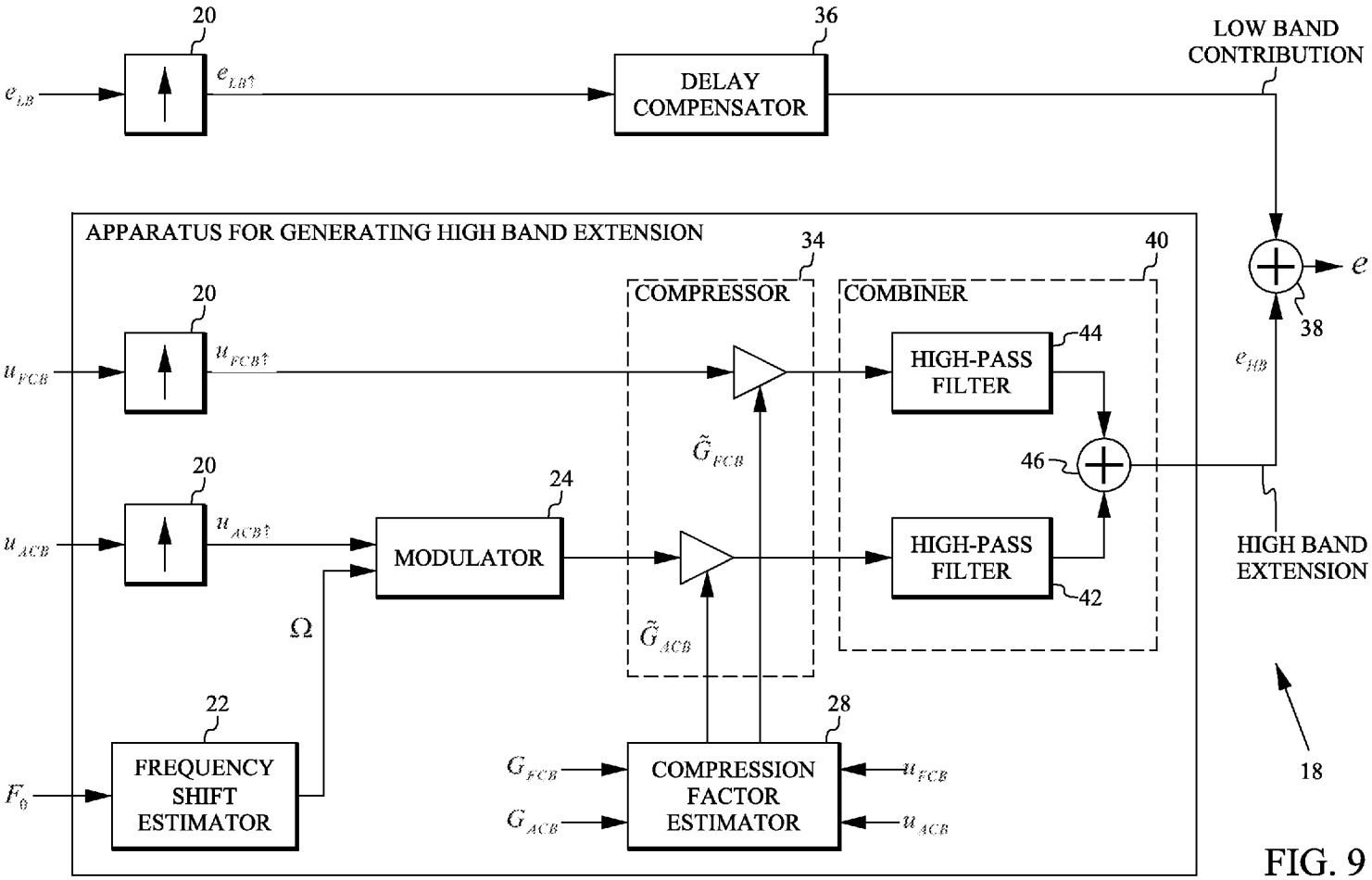
FIG. 9 is a block diagram illustrating an excitation signal bandwidth extender including another example embodiment of the apparatus in accordance with the present invention.

FIG. 9 is a block diagram illustrating an excitation signal bandwidth extender including another example embodiment of the apparatus in accordance with the present invention. Upsamplers 20 are configured to upsample a low band fixed codebook vector $u_{FCB}$ and a low band adaptive codebook vector $u_{ACB}$ to a predetermined sampling frequency $f_S$. A frequency shift estimator 22 is configured to determine a modulation frequency Ω from an estimated measure representing a fundamental frequency $F_0$ of the audio signal, for example in accordance with (2)-(3). A modulator 24 is configured to modulate the upsampled low band adaptive codebook vector $u_{ACB\uparrow}$ with the determined modulation frequency Ω to form a frequency shifted adaptive codebook vector. A compression factor estimator 28 is configured to estimate a compression factor λ, for example by using a lookup table based on (9), (10) or (11). A compressor 34 is configured to attenuate the frequency shifted adaptive codebook vector and the upsampled fixed codebook vector $u_{FCB\uparrow}$ based on the estimated compression factor λ. In a particular example based on equation (12) the compressor 34 multiplies the frequency shifted adaptive codebook vector by an adaptive codebook gain defined by $\tilde{G}_{ACB}$ and the upsampled fixed codebook vector by a fixed codebook gain defined by $\tilde{G}_{FCB}$. A combiner 40 is configured to form a high-pass filtered sum $e_{HB}$ of the attenuated frequency shifted adaptive codebook vector and the attenuated upsampled fixed codebook vector. In the example this is done by high-pass filtering the attenuated frequency shifted adaptive codebook vector and the attenuated upsampled fixed codebook vector in high-pass filters 42 and 44, respectively, and forming the sum in an adder 46 after filtering. An alternative is to add the attenuated frequency shifted adaptive codebook vector to the attenuated upsampled fixed codebook vector first and high-pass filter the sum.

In the bandwidth extender 18 in FIG. 9, the LB excitation signal $e_{LB}$ is upsampled in an upsampler 20. The upsampled LB excitation signal $e_{LB\uparrow}$ is forwarded to a delay compensator 36, which delays it to compensate for the delay caused by the generation of the HB extension $e_{HB}$. The resulting LB contribution is added to the HB extension $e_{HB}$ in an adder 38 to form the bandwidth extended excitation signal e.

Figure 10:
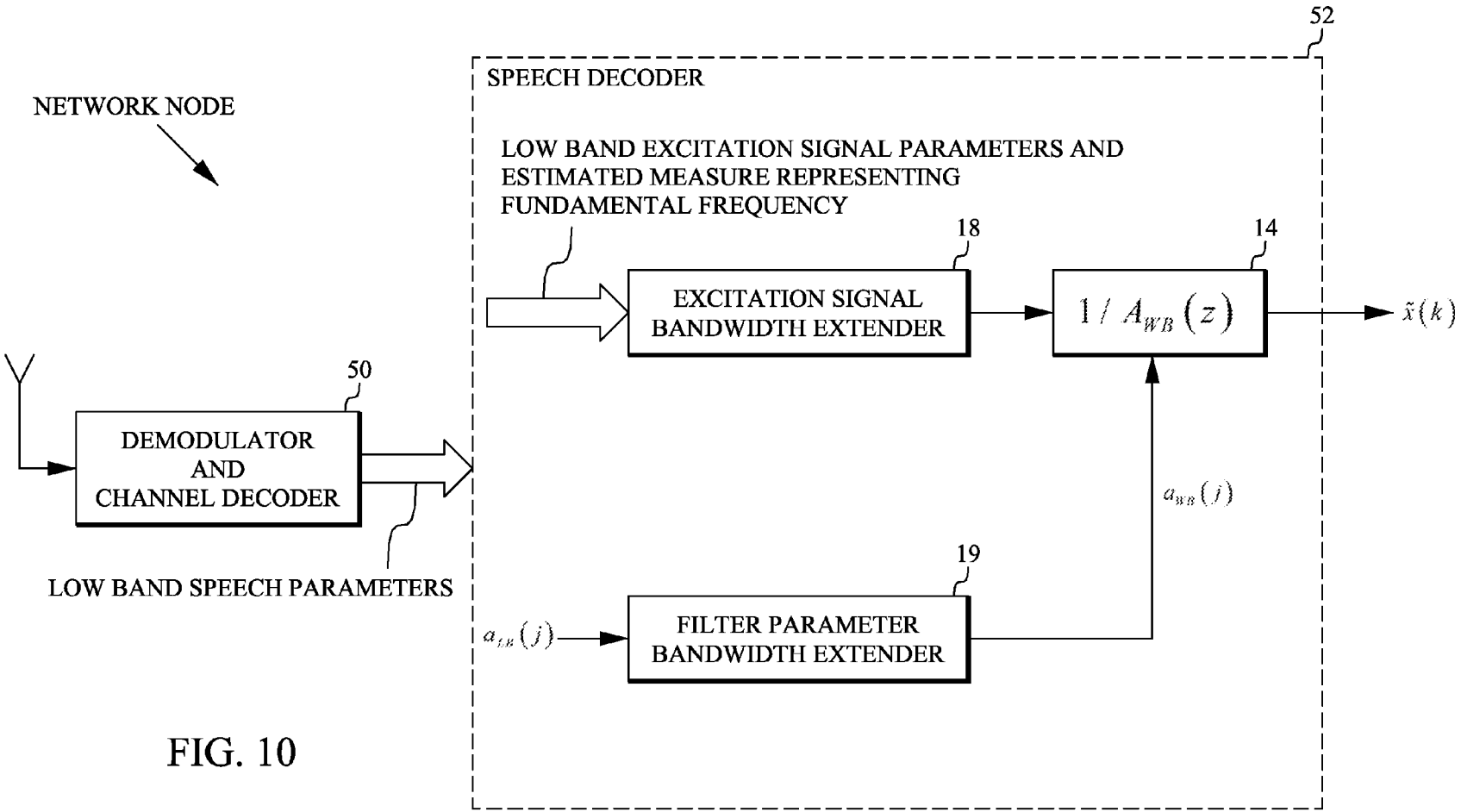
FIG. 10 is a block diagram illustrating an example embodiment of a network node including a speech decoder in accordance with the present invention.

FIG. 10 is a block diagram illustrating an embodiment of a network node including a speech decoder in accordance with the present invention. This embodiment illustrates a radio terminal, but other network nodes are also feasible. For example, if voice over IP (Internet Protocol) is used in the network, the nodes may comprise computers.

In the network node in FIG. 10 an antenna receives a coded speech signal. A demodulator and channel decoder 50 transforms this signal into low band speech parameters, which are forwarded to a speech decoder 52. From these speech parameters the low band excitation signal parameters (for example $u_{ACB}$, $u_{FCB}$, $G_{ACB}$, $G_{FCB}$) and measure representing the fundamental frequency ($F_0$) are forwarded to an excitation signal bandwidth extender 18 in accordance with the present invention. The speech parameters representing the filter parameters $a_{LB}(j)$ are forwarded to a filter parameter bandwidth extender 19. The bandwidth extended excitation signal and filter coefficients $a_{WB}(j)$ are forwarded to an all-pole filter 14 to produce the decoded speech signal $\tilde{x}(k)$.

The steps, functions, procedures and/or blocks described above may be implemented in hardware using any conventional technology, such as discrete circuit or integrated circuit technology, including both general-purpose electronic circuitry and application-specific circuitry.

Alternatively, at least some of the steps, functions, procedures and/or blocks described above may be implemented in software for execution by a suitable processing device, such as a micro processor, Digital Signal Processor (DSP) and/or any suitable programmable logic device, such as a Field Programmable Gate Array (FPGA) device.

It should also be understood that it may be possible to re-use the general processing capabilities of the network nodes. This may, for example, be done by reprogramming of the existing software or by adding new software components.

Figure 11:
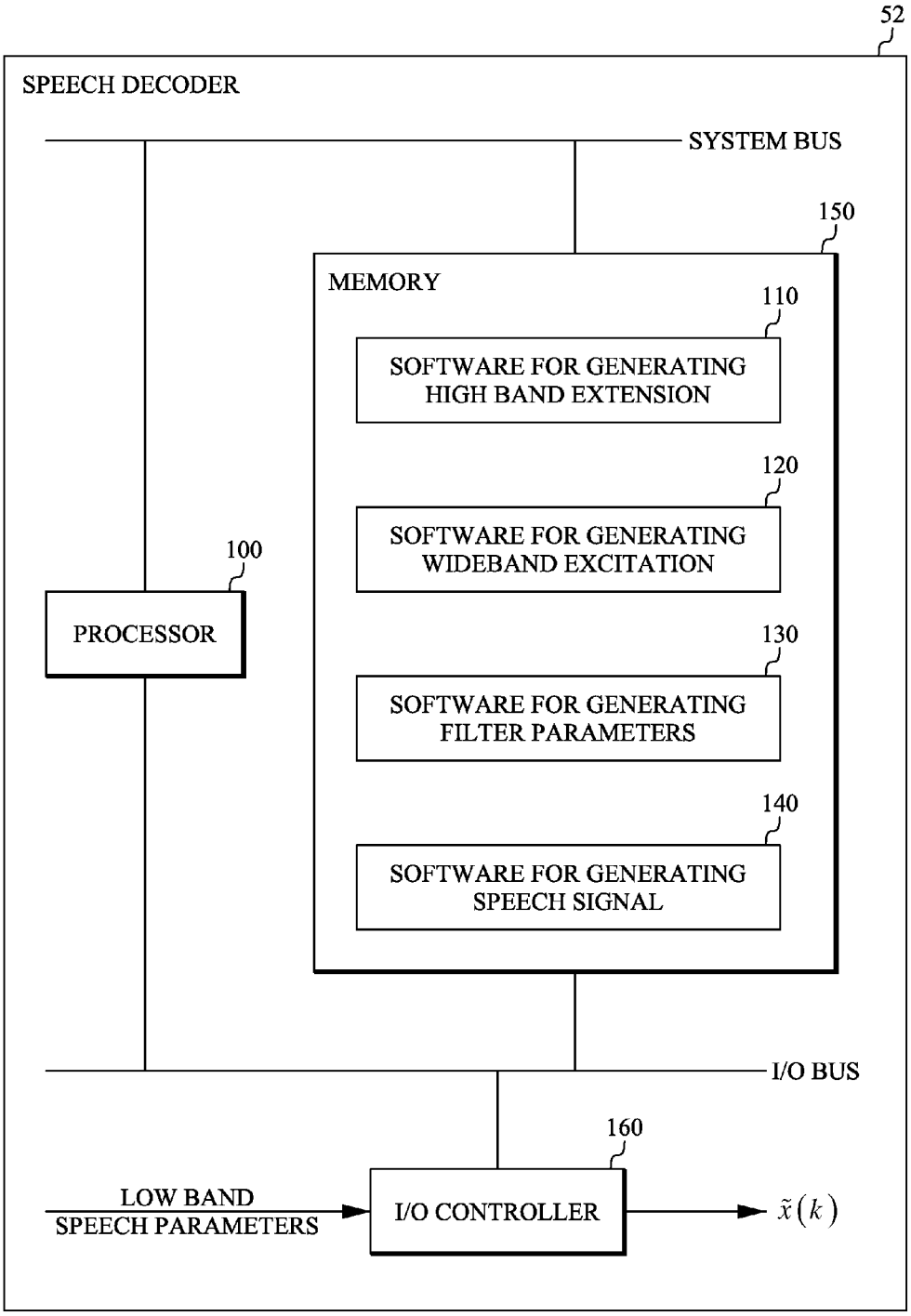
FIG. 11 is a block diagram illustrating an example embodiment of a speech decoder in accordance with the present invention.

As an implementation example, FIG. 11 is a block diagram illustrating an example embodiment of a speech decoder 52 in accordance with the present invention. This embodiment is based on a processor 100, for example a micro processor, which executes a software component 110 for generating the high band extension, a software component 120 for generating the wideband excitation, a software component 130 for generating filter parameters and a software component 140 for generating the speech signal from the wideband excitation and the filter parameters. This software is stored in memory 150. The processor 100 communicates with the memory over a system bus. The low band speech parameters are received by an input/output (I/O) controller 160 controlling an I/O bus, to which the processor 100 and the memory 150 are connected. In this embodiment the speech parameters received by the I/O controller 150 are stored in the memory 150, where they are processed by the software components. Software component 110 may implement the functionality of blocks 20, 22, 24, 26, 28 34 in the embodiment of FIG. 7 or blocks 20, 22, 24, 28, 34, 40 in the embodiment of FIG. 9. Software component 120 may implement the functionality of blocks 36, 38 in the embodiment of FIG. 7 or blocks 20, 36, 38 in the embodiment of FIG. 9. Together software components 110, 120 implement the functionality of the excitation bandwidth extender 18. The functionality of filter parameter bandwidth extender 19 is implemented by software component 130. The speech signal $\tilde{x}(k)$ obtained from software component 140 is outputted from the memory 150 by the I/O controller 160 over the I/O bus.

In the embodiment of FIG. 11 the speech parameters are received by I/O controller 160, and other tasks, such as demodulation and channel decoding in a radio terminal, are assumed to be handled elsewhere in the receiving network node. However, an alternative is to let further software components in the memory 150 also handle all or part of the digital signal processing for extracting the speech parameters from the received signal. In such an embodiment the speech parameters may be retrieved directly from the memory 150.

In case the receiving network node is a computer receiving voice over IP packets, the IP packets are typically forwarded to the I/O controller 160 and the speech parameters are extracted by further software components in the memory 150.

Some or all of the software components described above may be carried on a computer-readable medium, for example a CD, DVD or hard disk, and loaded into the memory for execution by the processor.

It will be understood by those skilled in the art that various modifications and changes may be made to the present invention without departure from the scope thereof, which is defined by the appended claims.

ABBREVIATIONS

ACELP Algebraic Code Excited Linear Prediction
BWE BandWidth Extension
CELP Code Excited Linear Prediction
DSP Digital Signal Processor
FPGA Field Programmable Gate Array
HB High Band
I/O Input/Output
IP Internet Protocol
LB Low Band
LP Linear Predictive
IP Internet Protocol

REFERENCES

[1] 3GPP TS 26.190, "Adaptive Multi-Rate—Wideband (AMR-WB) speech codec; Transcoding functions," 2008.

[2] ITU-T Rec. G.718, "Frame error robust narrowband and wideband embedded variable bit-rate coding of speech and audio from 8-32 kbit/s," 2008.

[3] ITU-T Rec. G.729.1, "G.729-based embedded variable bit-rate coder: An 8-32 kbit/s scalable wideband coder bitstream interoperable with G.729," 2006.

The invention claimed is:

1. A method by an apparatus for generating a high band extension of a low band excitation signal defined by parameters representing a CELP encoded audio signal, the method comprising the steps of:

upsampling a low band fixed codebook vector ($u_{FCB}$) and a low band adaptive codebook vector to a predetermined sampling frequency;

determining a modulation frequency from an estimated measure representing a fundamental frequency of the audio signal;

modulating the upsampled low band adaptive codebook vector with the determined modulation frequency to form a frequency shifted adaptive codebook vector;

estimating a compression factor;

attenuating the frequency shifted adaptive codebook vector and the upsampled fixed codebook vector based on the estimated compression factor; and forming a high-pass filtered sum of the attenuated frequency shifted adaptive codebook vector and the attenuated upsampled fixed codebook vector.

2. The method of claim 1, wherein the modulation frequency Ω is determined using the following equation:

$$\Omega = n \cdot \frac{2\pi F_0}{f_S}$$

where $F_0$ is the estimated measure representing the fundamental frequency, $f_S$ is the sampling frequency, and n is defined as $$n = \text{floor}\left(\frac{W_{LB}}{F_0}\right) - \text{ceil}\left(\frac{W_{LB} - W_{HB}}{F_0}\right)$$

where floor rounds its argument to the nearest smaller integer, ceil rounds its argument to the nearest larger integer, $W_{LB}$ is the bandwidth of the low band excitation signal ($e_{LB}$), and $W_{HB}$ is the bandwidth of the high band extention.

3. The method of claim 1, wherein the upsampled low band excitation signal ($e_{LB\uparrow}$) is modulated using the following equation:

$$A \cdot \cos(l \cdot \Omega)$$

where

A is a predetermined constant, l is a sample index, and

Ω is the modulation frequency.

4. The method of claim 1, wherein the compression factor (λ) is estimated by estimating a measure (K) for the amount of tonal components in the low band excitation signal ($e_{LB}$);

selecting a corresponding compression factor (λ) from a lookup table.

5. The method of claim 4, wherein the measure K for the amount of tonal components in the low band excitation signal $e_{LB}$ is determined using the following equation:

$$K = \frac{G_{ACB}^2 \cdot \sum u_{ACB}^2(l)}{G_{FCB}^2 \cdot \sum u_{FCB}^2(l)}$$

where $G_{ACB}$ is an adaptive codebook gain, $u_{ACB}$ is the low band adaptive codebook vector, $G_{FCB}$ is a fixed codebook gain, and $u_{FCB}$ is the low band fixed codebook vector.

6. The method of claim 1, wherein the forming step comprises the steps of:

high-pass filtering the attenuated frequency shifted adaptive codebook vector and the attenuated upsampled fixed codebook vector; and summing the high-pass filtered vectors.

7. The method of claim 1, wherein the attenuation step comprises the steps of:

multiplying the frequency shifted adaptive codebook vector by an adaptive codebook gain defined by $\tilde{G}_{ACB}=\lambda \cdot G_{ACB}$; and multiplying the upsampled fixed codebook vector by a fixed codebook gain defined by $\tilde{G}_{FCB}=\sqrt{1-\tilde{G}_{ACB}^2}$, where λ is the estimated compression factor.

8. The method of claim 1, wherein the low band excitation signal is defined by parameters representing an ACELP coded audio signal.

9. The method of claim 4, wherein the measure K for the amount of tonal components in the low band excitation signal $e_{LB}$ is determined using the following equation:

$$K = \frac{\frac{1}{L}\sum_{l=1}^{L} e_{LB}^4(l)}{\left(\frac{1}{L}\sum_{l=1}^{L} e_{LB}^2(l)\right)^2}$$

where L is a speech frame length.

10. An apparatus for generating a high band extension of a low band excitation signal defined by parameters representing a CELP encoded audio signal, said apparatus comprising:

upsamplers configured to upsample a low band fixed codebook vector and a low band adaptive codebook vector to a predetermined sampling frequency;

a frequency shift estimator configured to determine a modulation frequency (Ω) from an estimated measure representing a fundamental frequency of the audio signal;

a modulator configured to modulate the upsampled low band adaptive codebook vector with the determined modulation frequency to form a frequency shifted adaptive codebook vector;

a compression factor estimator configured to estimate a compression factor;

a compressor configured to attenuate the frequency shifted adaptive codebook vector and the upsampled fixed codebook vector based on the estimated compression factor; and a combiner configured to form a high-pass filtered sum of the attenuated frequency shifted adaptive codebook vector and the attenuated upsampled fixed codebook vector.

11. The apparatus of claim 10, wherein the frequency shift estimator is configured to determine the modulation frequency Ω in accordance with $$\Omega = n \cdot \frac{2\pi F_0}{f_S}$$

where $F_0$ is the estimated measure representing the fundamental frequency, $f_S$ is the sampling frequency, and n is defined as $$n = \text{floor}\left(\frac{W_{LB}}{F_0}\right) - \text{ceil}\left(\frac{W_{LB} - W_{HB}}{F_0}\right)$$

where floor rounds its argument to the nearest smaller integer, ceil rounds its argument to the nearest larger integer, $W_{LB}$ is the bandwidth of the low band excitation signal ($e_{LB}$), and $W_{HB}$ is the bandwidth of the high band extension.

12. The apparatus of claim 10, wherein the modulator (24) is configured to modulate the upsampled low band excitation signal ($e_{LB\uparrow}$)

$$A \cdot \cos(l \cdot \Omega)$$

where

A is a predetermined constant, l is a sample index, and

Ω is the modulation frequency.

13. The apparatus of claim 10, wherein the compression factor estimator is configured to estimate the compression factor (λ) by estimating a measure (K) for the amount of tonal components in the low band excitation signal ($e_{LB}$); and selecting a corresponding compression factor (λ) from a lookup table.

14. The apparatus of claim 13, wherein the compression factor estimator is configured to estimate the measure K for the amount of tonal components in the low band excitation signal $e_{LB}$ using the following equation:

$$K = \frac{G_{ACB}^2 \cdot \sum u_{ACB}^2(l)}{G_{FCB}^2 \cdot \sum u_{FCB}^2(l)}$$

where $G_{ACB}$ is an adaptive codebook gain, $u_{ACB}$ is the low band adaptive codebook vector, $G_{FCB}$ is a fixed codebook gain, and $u_{FCB}$ is the low band fixed codebook vector.

15. The apparatus of claim 10, wherein the combiner comprises:

high-pass filters configured to high-pass filter the attenuated frequency shifted adaptive codebook vector and the attenuated upsampled fixed codebook vector; and a summation unit configured to sum the high-pass filtered vectors.

16. The apparatus of claim 10, wherein the compressor is configured to:

multiply the frequency shifted adaptive codebook vector by an adaptive codebook gain defined by $\tilde{G}_{ACB}=\lambda\cdot G_{ACB}$; and multiply the upsampled fixed codebook vector by a fixed codebook gain defined by $\tilde{G}_{FCB}=\sqrt{1-\tilde{G}_{ACB}^{2}}$, where $\lambda$ is the estimated compression factor.

17. The apparatus of claim 10, wherein the low band excitation signal is defined by parameters representing an ACELP coded audio signal.

18. The apparatus of claim 13, wherein the compression factor estimator is configured to estimate the measure K for the amount of tonal components in the low band excitation signal $e_{LB}$ using the following equation:

$$K=\frac{\frac{1}{L}\sum_{l=1}^{L}e_{LB}^{4}(l)}{\left(\frac{1}{L}\sum_{l=1}^{L}e_{LB}^{2}(l)\right)^{2}}$$

where L is a speech frame length.

19. An excitation signal bandwidth extender including the apparatus in accordance with claim 10.

20. A speech decoder including the excitation signal bandwidth extender in accordance with claim 19.

21. A network node including the speech decoder in accordance with claim 20.

22. The network node of claim 21, wherein the network node is a radio terminal.

* * * * *

UNITED STATES PATENT AND TRADEMARK OFFICE

CERTIFICATE OF CORRECTION

PATENT NO. : 8,856,011 B2
APPLICATION NO. : 13/509849
DATED : October 7, 2014
INVENTOR(S) : Sverrisson et al.

It is certified that error appears in the above-identified patent and that said Letters Patent is hereby corrected as shown below:

On the title page, item (57), under "ABSTRACT", in Column 2, Line 17, delete "($u_{FCB\dagger}$.)" and insert -- ($u_{FCB\dagger}$) --, therefor.

In the Specification

In Column 1, Line 11, delete "dislosure" and insert -- disclosure --, therefor.

In Column 3, Line 13, delete "forth" and insert -- fourth --, therefor.

In the Claims

In Column 12, Line 58, in Claim 2, delete "extention." and insert -- extension. --, therefor.

Signed and Sealed this
Twelfth Day of May, 2015

Michelle K. Lee

Michelle K. Lee
*Director of the United States Patent and Trademark Office*